US007114253B2

(12) United States Patent
Murakami et al.

(10) Patent No.: US 7,114,253 B2
(45) Date of Patent: Oct. 3, 2006

(54) MALE TERMINAL FITTING AND METHOD OF MANUFACTURING THE SAME

(75) Inventors: Takao Murakami, Shizuoka-ken (JP); Chieko Torii, Shizuoka-ken (JP); Isao Nishimura, Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 353 days.

(21) Appl. No.: 10/829,308

(22) Filed: Apr. 20, 2004

(65) Prior Publication Data

US 2004/0224576 A1 Nov. 11, 2004

Related U.S. Application Data

(62) Division of application No. 10/060,300, filed on Feb. 1, 2002, now Pat. No. 6,752,669.

(30) Foreign Application Priority Data

Feb. 13, 2001 (JP) ..... 2001-036001
May 16, 2001 (JP) ..... 2001-146830
Aug. 6, 2001 (JP) ..... 2001-238137

(51) Int. Cl.
*H01R 43/00* (2006.01)

(52) U.S. Cl. ..... 29/884; 29/874; 29/882

(58) Field of Classification Search ..... 29/874, 29/882, 884
See application file for complete search history.

(56) References Cited

U.S. PATENT DOCUMENTS 1,982,501 A * 11/1934 Douglas ..... 439/787
2,738,484 A * 3/1956 Beckman et al. ..... 439/786
4,298,242 A * 11/1981 McKee ..... 439/733.1
4,981,451 A * 1/1991 Undin et al. ..... 439/885
5,495,669 A * 3/1996 Legrady et al. ..... 29/885
5,666,723 A * 9/1997 Ohtaka et al. ..... 29/874
6,077,131 A 6/2000 Fukuda et al.
2003/0017757 A1 1/2003 Murakami et al.

FOREIGN PATENT DOCUMENTS

| | | |
|---|---|---|
| EP | 0 693 798 A1 | 1/1996 |
| JP | 56-169377 | 12/1981 |
| JP | 3-39275 | 4/1991 |
| JP | 10-128572 | 5/1998 |

* cited by examiner

*Primary Examiner*—Carl J. Arbes
(74) *Attorney, Agent, or Firm*—Finnegan, Henderson, Farabow, Garrett & Dunner, L.L.P.

(57) ABSTRACT

A male terminal fitting and a method of manufacturing the same is disclosed as including a plate-shaped contact protrusion (11, 31, 41, 51) formed at one side for mating with a female terminal fitting, and a conductor clamping portion (12, 32, 42, 52) located at the other side for clamping a conductor of an electric wire. The plate-shaped contact protrusion includes a base plate component (14, 34, 44, 54) extending from the conductor clamping portion in a longitudinally elongated shape, and an overlapping fold plate component (15, 35, 36, 45, 46, 55) laterally extending from a side of the base plate component. The plate-shaped contact protrusion further includes a flatness securing plate component (16, 35, 44, 56) laterally extending from the base plate component and overlaps with the overlapping fold plate component to ensure flatness conditions of the base plate component and the overlapping fold plate component. In the method, a plurality of sequentially arrayed male terminal fittings are formed by stamping operation and a forming operation is implemented to form each of the terminal fittings into final shapes, respectively.

3 Claims, 9 Drawing Sheets

MALE TERMINAL FITTING AND METHOD OF MANUFACTURING THE SAME

This is a division of application Ser. No. 10/060,300, filed Feb. 1, 2002, now U.S. Pat. No. 6,752,669 and claims the benefit of Japanese Application Nos. 2001-036001, filed Feb. 13, 2001, 2001-146830 filed May 6, 2001, and 2001-238137 filed Aug. 6, 2001, all of which are incorporated herein by reference.

BACKGROUND OF THE INVENTION

The present invention relates to male terminal fittings and, more particularly, a male terminal fitting having a contact protrusion and a method of manufacturing the same.

Various attempts have heretofore been undertaken to develop a male terminal fitting of the type having a plate-shape contact protrusion as disclosed in FIGS. 1 and 2. In such a male terminal fitting, the plate shape contact segment 1 is fabricated first by stamping a conductive thin metal sheet in a developed stage and subsequently bending the thin sheet metal into a final product. In particular, the plate-shaped contact protrusion 1 is comprised of an elongated base plate component 2, and an overlapping fold plate component laterally extending from one end of the base plate component and folded to lie over the base plate component 2. a distal end 3*a* of the overlapping fold plate component 3 is further folded toward the base plate component 2 such that a tabular portion 4 is formed. The presence of the hollow portion 4 enables the plate-shape contact protrusion 1 to have a desired thickness L1 even when using the thin sheet material.

However, since the tabular portion 4 is internally formed when forming the overlapping fold plate component 3 toward the base plate component 2, central portions of the base plate component 2 and the overlapping fold plate component 3 are caused to be collapsed in depths L2, L3, respectively, due to external press forces exerted thereto during the forming operation as shown in FIG. 2.

With such deformations, the base plate component 2 and the overlapping fold plate component 3 do not have desired flatness, resulting in a decrease in contact surface areas against mating walls of an associated female terminal fitting with a degraded reliability in electrical contact.

To address such an issue, another attempt has been proposed to develop a male terminal fitting whose plate-shaped contact protrusion is shown in FIGS. 3 and 4, wherein a base plate component has a longitudinal extension 7 which is folded back to form an overlapped structure on which overlapping plate components 6, 6 are folded inward to lie on the overlapped structure as disclosed in Japanese Patent Provisional Publication No. 10-3956. With such a structure, even when the plate-shape contact protrusion is exerted with the external press forces, the presence of the overlapped structure 7, which is laminated with the overlapping plate components 6, 6, avoids the central portions of the base plate component 2 and the overlapping plate components 6, 6 from being collapsed.

However, with a particular structure proposed in such a Japanese Provisional Publication, the presence of the longitudinal extension 7, which longitudinally extends from the distal end of the base plate component, needs an elongated sheet material with a remarkably increased width, causing an increase in a material cost and an increase in waste material.

Further, the presence of a bending step for bending the longitudinal extension 7 such that it is folded back to the base plate component 5 is reflected in an increase in the number of bending formation steps, thereby increasing the manufacturing cost of the male terminal fitting.

SUMMARY OF THE INVENTION

The present invention has been made with a view to addressing the above issues and has an object to provide a male terminal fitting and a method of manufacturing the same which is reliable in ensuring a flatness in a base plate component and an overlapping fold plate component while enabling the male terminal fitting to be manufactured at a low material cost and a low manufacturing cost.

To achieve the above object, according to a first aspect of the present invention, there is provided a male terminal fitting comprising: a plate-shape contact protrusion formed at one side of said male terminal fitting for mating with a female terminal fitting; and a conductor clamping portion located at the other side of said male terminal fitting to allow a conductor of an electric wire to be clamped; wherein said plate-shaped contact protrusion includes a base plate component longitudinally extending from said conductor clamping portion in an elongated plate shape, an overlapping fold plate component laterally extending from one side of said base plate component and folded to overlap with said base plate component, and a flatness securing plate component overlapping with said base plate component and said overlapping fold plate component to enhance flatness conditions of said base plate component and said overlapping fold plate component, respectively.

According to a second aspect of the present invention, there is provided a male terminal fitting comprising: a plate-shape contact protrusion formed at one side of said male terminal fitting formatting with a female terminal fitting; and a conductor clamping portion located at the other side of said male terminal fitting for clamping a conductor of an electric wire; wherein said plate-shaped contact protrusion includes a base plate component longitudinally extending from said conductor clamping portion in an elongated plate shape, a first overlapping fold plate component laterally extending from one side of said base plate component and folded in one direction toward the other end of said base plate component to overlap with said base plate component, and a second overlapping fold plate component which extends from said first overlapping fold plate component at a position close to the other end of said base plate component: and which is folded back in another direction opposed to said one direction to overlap with said first overlapping fold plate component; and wherein said first overlapping fold plate component serves as a flatness securing plate component to ensure flatness conditions of said base plate component and said second overlapping fold plate component, respectively.

According to a third aspect of the present invention, there is provided a male terminal fitting comprising: a plate-shaped contact protrusion formed at one side of said male terminal fitting for mating with a female terminal fitting; and a conductor clamping portion located at the other side of said male terminal fitting for clamping a conductor of an electric wire; wherein said plate-shape contact protrusion includes a base plate component longitudinally extending from said conduct clamping portion in an elongated plate shape, a first overlapping fold plate component laterally extending from one side of said base plate component and folded in one direction toward the other end of said base plate component to overlap with said base plate component, and a second overlapping fold plate component which extends from the other end of said base plate component and which is folded back in another direction opposed to said one direction to overlap with said base plate component; and wherein said base plate component serves as a flatness securing plate component to ensure flatness conditions of said first and second overlapping fold plate components, respectively.

In other words, according to a fourth aspect of the present invention, there is provided a male terminal fitting comprising: plate-shaped contact means formed at one side of said male terminal fitting for mating with a female terminal fitting; and conductor clamping means located at the other side of said male terminal fitting for clamping a conductor of an electric wire; wherein said plate-shaped contact means includes base means longitudinally extending from said conduct clamping means in an elongated plate shape, overlapping fold means laterally extending from one side of said base means and folded to overlap with said base means, and flatness securing means overlapping with said base means and said overlapping fold means to enhance flatness conditions of said base means and said overlapping fold means, respectively.

According to a fifth aspect of the present invention, there is provided a male terminal fitting comprising: plate-shaped contact means formed at one side of said male terminal fitting for mating with a female terminal fitting; and conductor clamping means located at the other side of said male terminal fitting for clamping a conductor of an electric wire; wherein said plate-shaped contact means includes base means longitudinally extending from said conductor clamping means in an elongated plate shape, first overlapping fold means laterally extending from one side of said base means and folded in one direction toward the other end of said base means to overlap with said base means, and second overlapping fold means which extends from said first overlapping fold means at a position close to the other end of said base means and which is folded back in another direction opposed to said one direction to overlap with said first overlapping fold means; and wherein said first overlapping fold means serves as flatness securing means to ensure flatness conditions of said base means and said second overlapping fold means, respectively.

According to a sixth aspect of the present invention, there is provided a male terminal fitting comprising: plate-shaped contact means formed at one side of said male terminal fitting for mating with a female terminal fitting; and conductor clamping means located at the other side of said male terminal fitting for clamping a conductor of an electric wire; wherein said plate-shaped contact means includes base means longitudinally extending from said conductor clamping means in an elongated plate shape, first overlapping fold means laterally extending from one side of said base means and folded in one direction toward the other end of said base means to overlap with said base means, and second overlapping fold means which extends from the other end of said base means and which is folded back in another direction opposed to said one direction to overlap with said base means; and wherein said base means serves as flatness securing means to ensure flatness conditions of said first and second overlapping fold means, respectively.

On the other hand, a first male terminal fitting manufacturing method of the present invention comprises: preparing a blank sheet of elongated conductive metal sheet; stamping said, elongated conductive metal sheet to form a plurality of sequentially arrayed terminal fittings, in developed states, which are integrally connected to a carrier, each of said terminal fittings including a conductor clamping portion extending from said carrier, a clamping body connected to said conductor clamping portion, and a plate-shaped contact protrusion which is composed of a base plate component longitudinally extending from said conductor clamping portion via said clamping body, a flatness securing plate component laterally extending from one side of said base plate component, and a overlapping fold plate component laterally extending from the other side of said base plate; and forming said conductor clamping portion, said clamping body band said plate-shaped contact protrusion into respective final shapes; wherein, after said forming step, said flatness securing plate overlaps with said overlapping fold plate component to ensure flatness conditions of said base plate component and said overlapping plate component, respectively.

A second male terminal fitting manufacturing method of the present invention comprises: preparing a blank sheet of elongated conductive metal sheet; stamping said elongated conductive metal sheet to form a plurality of sequentially arrayed terminal fittings, in developed states, which are integrally connected to a carrier, each of said terminal fittings including a conductor clamping portion extending from said carrier, a clamping body connected to said conductor clamping portion, and a plate-shaped contact protrusion which is composed of a base plate component longitudinally extending from said conductor clamping portion via said clamping body, a first overlapping plate component laterally extending from one side of said base plate component, and a second overlapping fold plate component laterally extending from the other side of said base plate; and forming said connecting segment, said clamping body and said plate-shaped contact protrusion into respective final shapes; wherein, after said forming step, said base plate component overlaps with said first and second overlapping fold plate components and serves as a flatness securing plate component to ensure flatness conditions of said first and second overlapping fold plate components, respectively.

A third male terminal fitting manufacturing method of the present invention comprises: preparing a blank sheet of elongated conductive metal sheet; stamping said elongated conductive metal sheet to form a plurality of sequentially arrayed terminal fittings, in developed states, which are integrally connected to a carrier, each of said terminal fittings including a conductor clamping portion extending from said carrier, a clamping body connected to said conductor clamping portion, and a plate-shaped contact protrusion which is composed of a base plate component longitudinally extending from said conductor clamping portion via said clamping body, a flatness securing plate component laterally extending from one side of said base plate component, and an overlapping folding plate component laterally extending from the other side of said base plate; and forming said conductor clamping portion, said clamping body band said plate-shaped contact protrusion into respective final shapes; wherein, after said forming step, said flatness securing plate component overlaps with said base plate component and said overlapping fold component to ensure flatness conditions of said base plate component and said overlapping fold plate component, respectively.

DETAILED DESCRIPTION OF THE PREFERRED EMBODIMENTS

Figure 1:
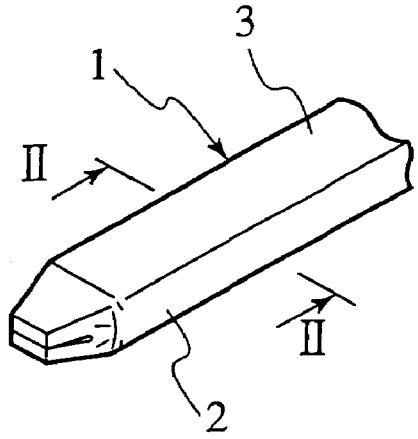
FIG.1 BACKGROUND ART
FIG. 1 is a perspective view illustrating a contact protrusion of a male terminal fitting of the related art.
Figure 2:
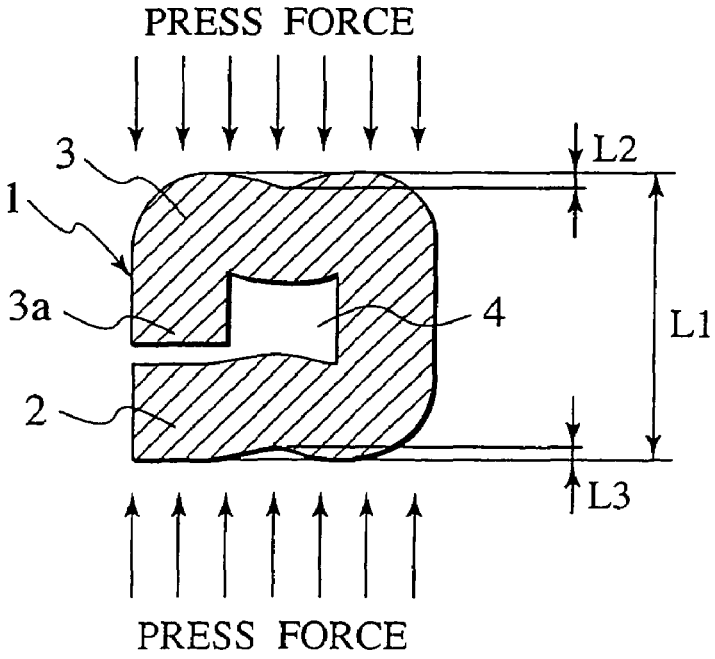
FIG.2 BACKGROUND ART
FIG. 2 is a cross sectional view taken on line II—II of FIG. 1 for illustrating the contact protrusion of the male terminal fitting of the related art.
Figure 3:
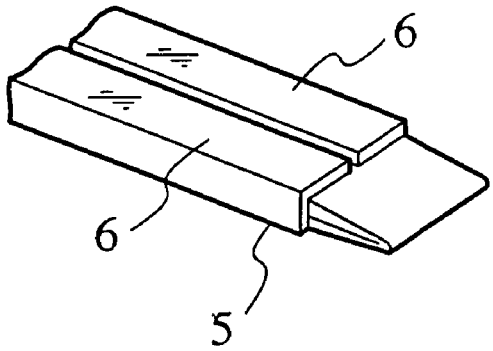
FIG.3 BACKGROUND ART
FIG. 3 is a perspective view illustrating a contact protrusion of another male terminal fitting of the related art.
Figure 4:
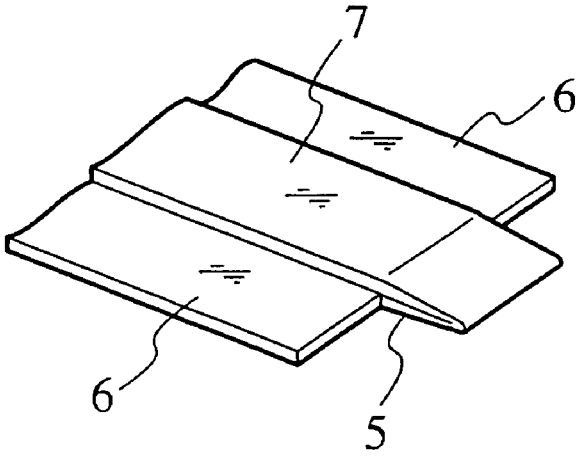
FIG.4 BACKGROUND ART
FIG. 4 is a perspective view illustrating the contact protrusion, in a partly developed form, of another male terminal fitting shown in FIG. 3.
Figure 5A:
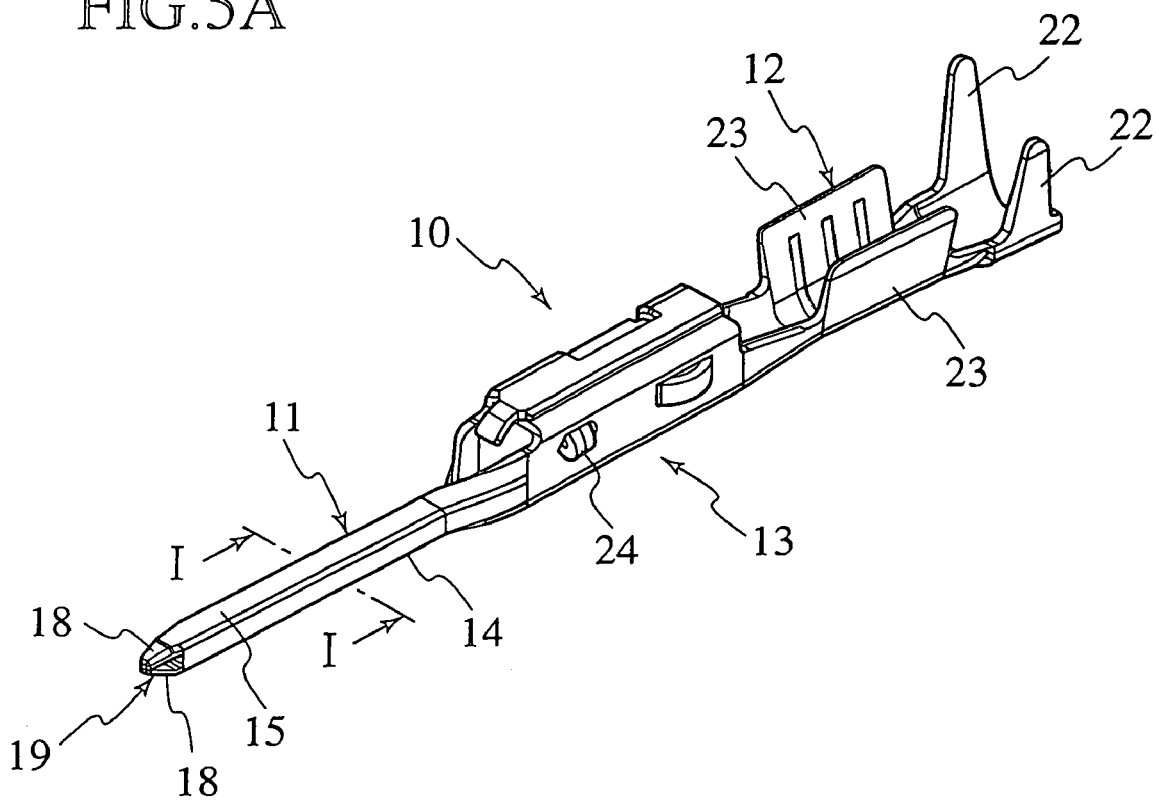
FIG. 5A is a perspective view of a male type terminal fitting of a first preferred embodiment according to the present invention.
Figure 5B:
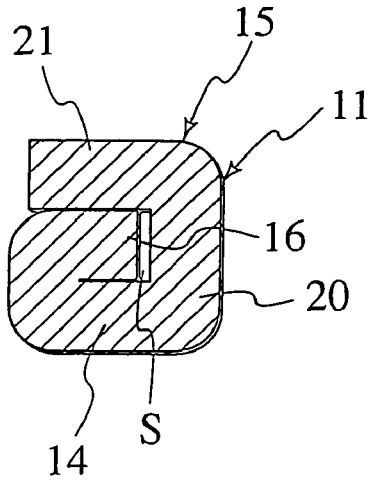
FIG. 5B is a cross sectional view taken on line I—I of FIG. 5A.
Figure 6:
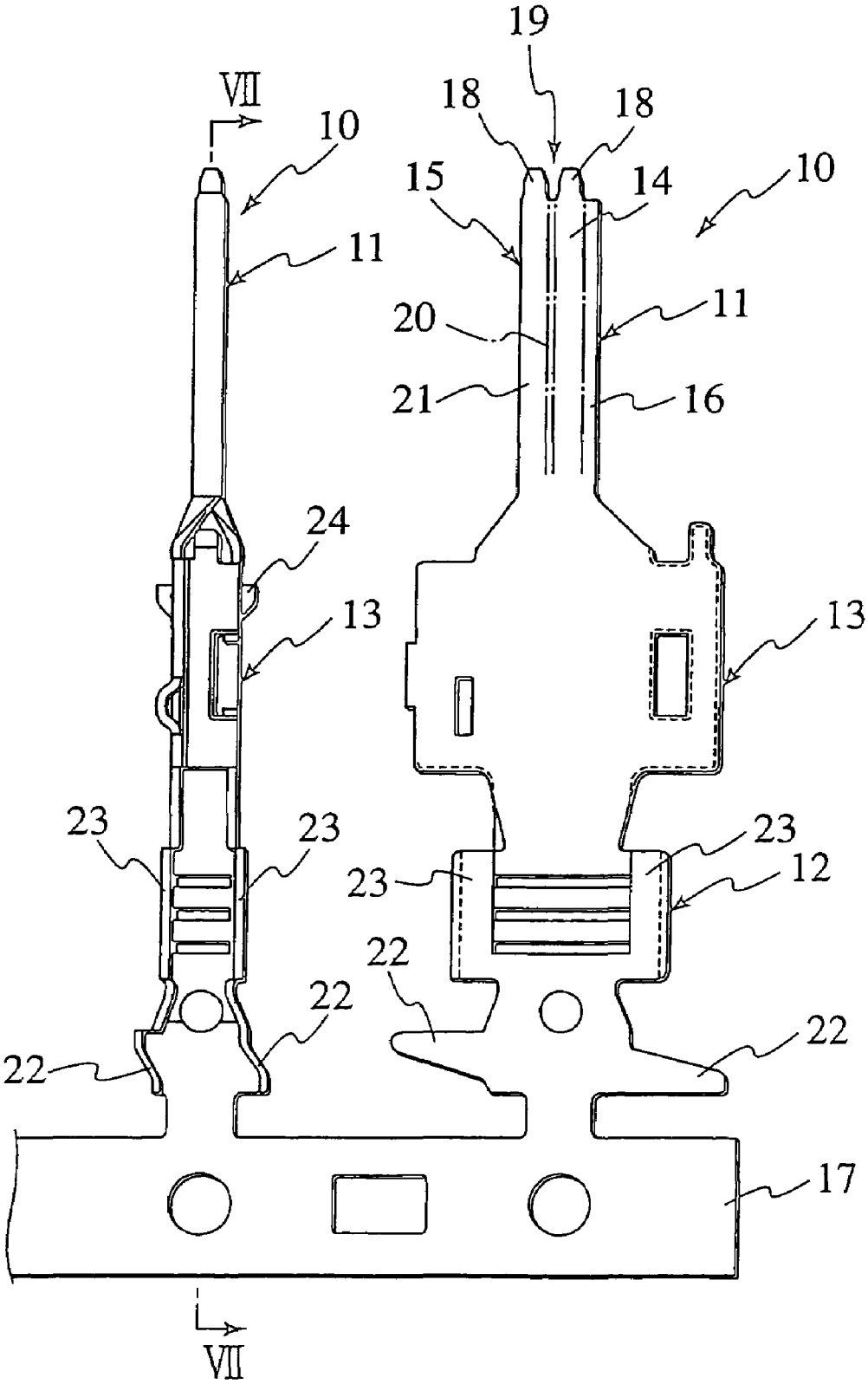
FIG. 6 is a plan view illustrating two male terminal fittings, one of which is shown in a finally completed stage and another of which is shown in a developed stage.
Figure 7:
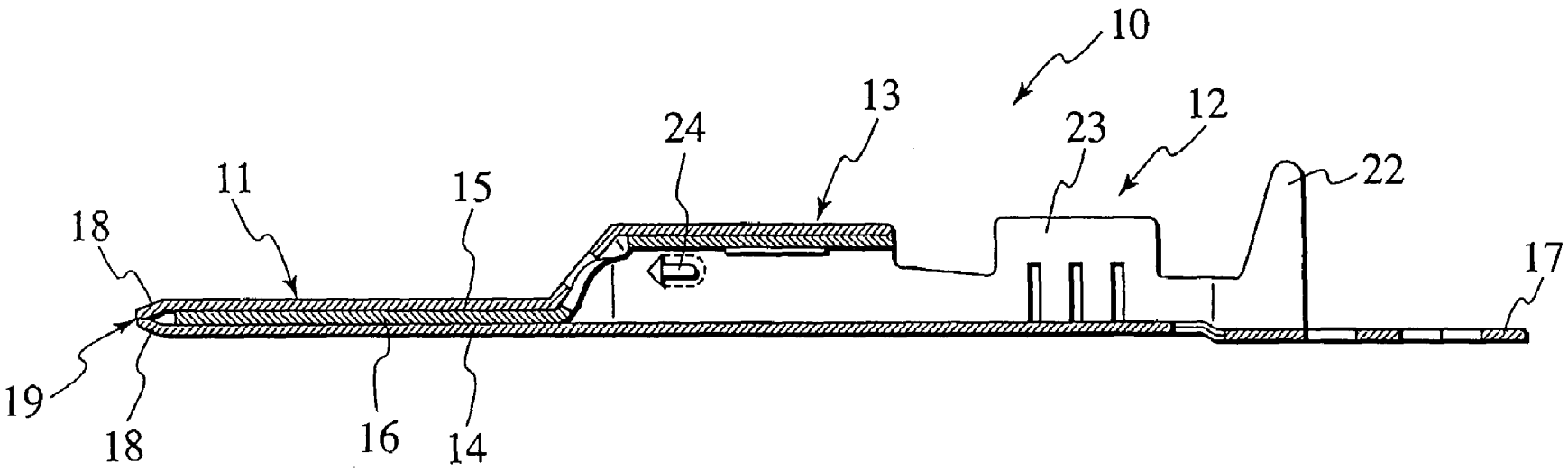
FIG. 7 is a cross sectional view taken on line VII—VII of FIG. 6.

To describe the present invention more in detail, a male terminal fitting of a first preferred embodiment of the present invention to carry out a male terminal fitting manufacturing method of the present invention will be explained below with reference to FIGS. 5A and 5B and FIGS. 6 and 7. FIG. 5A is a perspective view illustrating a male terminal fitting 10 of a first preferred embodiment according to the present invention. FIG. 5B is a cross sectional view taken on line I—I of FIG. 5A. FIG. 6 is a plan view illustrating the male terminal fitting of the first preferred embodiment after forming operation and in a developed condition. FIG. 7 is a cross sectional view taken on line VII—VII of FIG. 6.

As shown in FIGS. 5A, 5B, 6 and 7, the male terminal fitting 10 is formed by stamping out a terminal element in a developed state from an elongated conductive metal sheet, made of aluminum alloy or copper alloy, and then press forming the terminal element into the male terminal fitting 10 in a final shape.

One end of the male terminal fitting 10 is formed with a plate-shaped contact protrusion 11, that extends in a longitudinal direction, for mating with a female terminal fitting, and the other end of the male terminal fitting 10 is formed with a conductor clamping portion 12 for clamping a conductor of an electric wire (not shown) is connected. Located between the plate-shaped contact protrusion 11 and the conductor clamping portion 12 is a clamping body 13.

The plate-shaped contact protrusion 11 is comprised of a base plate component 14 elongated from the conductor clamping portion 12, an overlapping fold component 15 which extends along one side of the base plate component 14 in the longitudinal direction and which is folded to overlap with the base plate component 14, and a flatness securing plate component 16 which extends along the other side of the base plate component 14 and which overlaps with the base plate component 14 and the overlapping fold plate component 15, with these component parts being formed in a rolled shape.

The flatness securing plate component 16 functions as a core element to enable the base plate component 14 and the overlapping fold plate component 15 to be held in flatness condition, respectively. As shown in FIG. 6, the base plate component 14 is contiguous with the clamping body 13, the conductor clamping portion 12 and a carrier 17, and forms bottom wall portions of the clamp body 13 and the conductor clamping 12. Further, a distal end of the base plate component 14 is integrally formed with a substantially triangle tongue 18 which is orientated in the longitudinal direction, with the triangle tongue 18 of the base plate component 14 and another triangle tongue 18 formed at a distal end of the overlapping fold plate component 15 being bent in overlapped condition with respect to one another to form a guide portion 19.

The overlapping fold plate component 15 is composed of a longitudinally extending side plate element 20 which extends from the one side of the base plate component 14 in a substantially perpendicular direction thereto, and a top plate element 21 contiguous with the side plate element 20 and extending from the side plate component 20 in substantially parallel to the base plate component 14, with the flatness securing plate component 16 overlapping with the base plate component 14 and the top plate element 21 to be formed in the rolled structure.

Further, the conductor clamping portion 12 is formed with a first pair of caulking segments 22, 22 for clamping a sheath of the electric wire, and a second pair of caulking segments 23, 23 for clamping the conductor of the electric wire. Furthermore, upon caulking operation for clamping the conductor and the sheath of the electric wire with the caulking segments 22, 22, 23, 23, the conductor of the electric wire is electrically connected to the male terminal fitting 10.

The clamping body 13, formed between the plate-shaped contact protrusion 11 and the conductor clamping portion 12, has a tabular structure with its both sides formed with outwardly extending clamp protrusions 24, 24. The clamping body 13 is clamped in an inner wall of a terminal receiver chamber of a connector housing in which the male terminal fitting 10 is received, thereby avoiding the male terminal fitting 10 from being removed out from the terminal receiver chamber.

FIG. 6 shows the male terminal fitting 10 which are formed by bending formation and the male terminal fitting formed in a developed state before bending operation, with both male terminal fittings 10 being shown as connected to the carrier 17. After completing the forming operation, the male terminal fittings are removed from the carrier in a final step. A large number of arrayed chain type terminal fittings 10 are first continuously stamped out from an elongated conductive sheet material with a given width in a developed state and are then continuously formed into a final product as shown in FIG. 5A. To this end, there is a so-called blank area, which forms a waste portion, between the adjacent male terminal fittings. In such a case, if the flatness securing plate component 16 is formed so as to longitudinally extend from the distal end of the connecting segment 12, then, an elongated sheet material in an increased width is required, with a resultant increase in the waste blank area.

With a particular structure of the male terminal fitting 10, the presence of the flatness securing plate component 16 located between the base plate component and the overlapping fold plate component 15 allows the conductor clamping portion 12 to have an increased strength. As a consequence, even when the plate shape contact segment 11 undergoes external press forces, the base plate component 14 and the overlapping fold plate component 15 are not deformed to prevent central areas of the contact protrusion from being collapsed, enabling the base plate component 14 and the overlapping fold plate component 15 to remain in desired flatness conditions, respectively, to obtain a reliable electrical contact with the associated female terminal fitting.

Also, the presence of the flatness securing plate component 16 formed at the other end of the base plate component 14 reduces the waste material that would be caused during stamping operation, with a resultant decrease in material cost.

In addition, when performing bending formation, the other side of the base plate component 14 is folded without bending the distal end of the base plate component 14 inward, providing an ease of bending formation.

Furthermore, in the male terminal fitting 10 of the preferred embodiment, since the flatness securing plate component 16 overlaps with the base plate component 14 and the top plate element 21 in the roll shape in cross section, there are some instances where a small gap S' is created among the flatness securing plate component 16 and the base plate component 14 and the top plate element 21 due to spring back actions caused in respective bent areas.

Figure 8A:
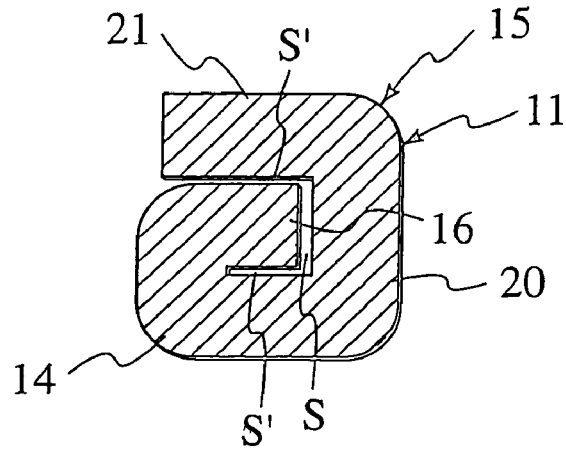
FIGS. 8A to 8C are cross sectional view of the plate-shaped contact protrusion similar to FIG. 5B for illustrating a condition wherein gap S' are formed due to spring back actions.
Figure 8B:
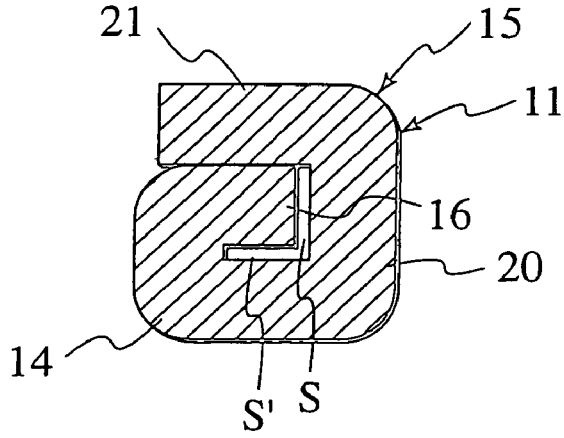
Figure 8C:
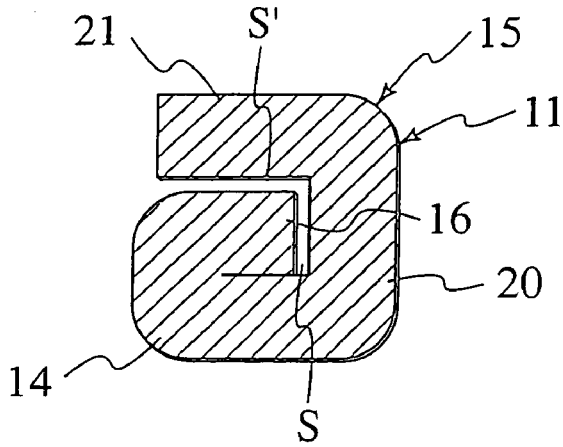

FIG. 8A shows a condition where small gaps S' are formed between the flatness securing plate component 16, and the base plate component 14 and the top plate element 21, respectively. FIG. 8B shows a condition where the small gap S' is formed between the flatness securing plate component 16 and the base plate component 14, and FIG. 8C shows a condition where the small gap S' is formed between the flatness securing plate component 16 and the top plate element 21.

Thus, even in the presence of such a small gaps S' formed among the flatness securing plate component 16, the base plate component 14 and the top plate element 21, the space S is extremely small. Also, the presence of the flatness condition, ensured with the flatness securing plate component 16 that overlaps with the base plate component 14 and the top plate element 21 in the roll shape in cross section, enables the plate-shaped contact protrusion 11 to have a remarkably increased strength. Thus, even when the plate-shaped contact protrusion 11 encounters the external press forces, no deformation is caused in the base plate component 14 and the top plate element 21 while precluding the central areas of the plate-shaped contact protrusion from being collapsed in the first preferred embodiment described above, while the flatness securing plate component 16 has been shown and described as extending from the other side of the base plate component 14, the flatness securing plate component may be modified so as to extend from the overlapping fold plate component 15.

In FIG. 5B, further, the space S has been shown and described as being created between the distal end of the flatness securing plate component 16 and the side plate element 20, it is preferable for the space S to have a value as small as possible to increase the surface area of the flatness securing plate component 161 for supporting the top plate element 21.

Now, a detailed description will be given to a male terminal fitting of a second preferred embodiment according to the present invention with reference to FIGS. 9A to 9C.

Figure 9A:
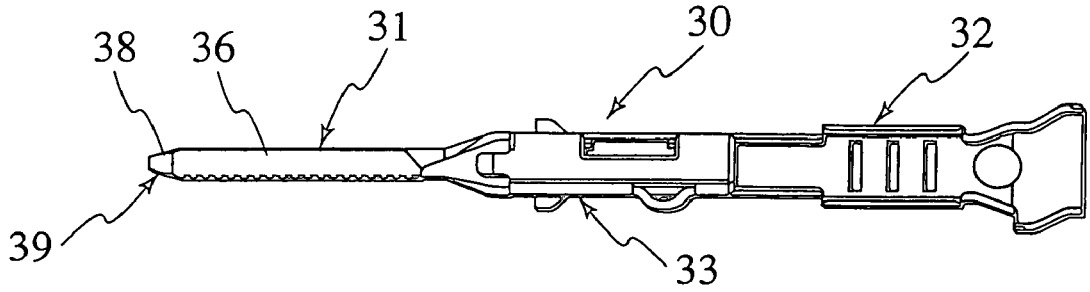
FIG. 9A is a plan view of a male terminal fitting of a second preferred embodiment according to the present invention.

FIG. 9A is a plan view illustrating the male terminal fitting 30 of the second preferred embodiment. FIG. 9B is a side view of the male terminal fitting 30 of the second preferred embodiment, and FIG. 9C is a cross sectional view taken on line IX—IX of FIG. 9B.

Figure 9B:
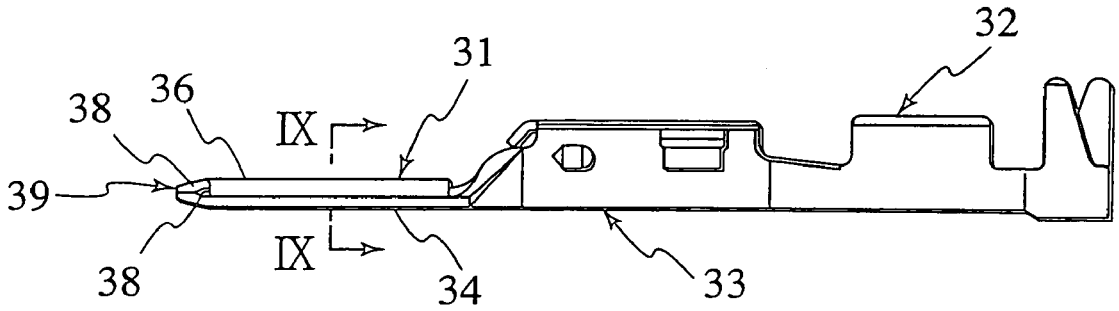
FIG. 9B is a side view of the male terminal fitting shown in FIG. 9A.
Figure 9C:
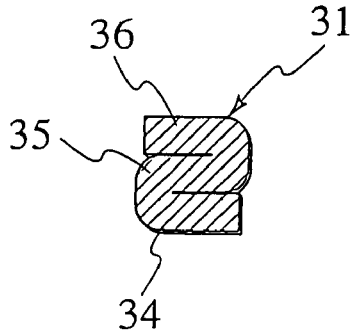
FIG. 9C is a cross sectional view taken on line IX—IX of FIG. 9B.

In the second preferred embodiment shown in FIGS. 9A to 9C, a plate-shaped contact protrusion 31 is comprised of a base plate component 34 longitudinally extending from a conductor clamping portion 32 and made of elongated metal sheet, a first overlapping fold plate component 35 laterally extending from one side of the base plate component 34 and folded to overlap with the base plate component 34, and a second overlapping fold plate component 36 which extends from the first overlapping fold plate component 35 in substantially parallel thereto and overlaps with the first overlapping plate component 35, thereby forming a substantially S-shape in cross section. The first overlapping fold plate component 35 have the same function as the flatness securing plate component 16 of the first preferred embodiment to ensure flatness conditions of the base plate component 34 and the second overlapping fold plate component 36, respectively.

Further, the male terminal fitting 30 of the second preferred embodiment has a similar shape in structure as that of the first preferred embodiment except for the plate-shaped contact protrusion 31. As shown in FIG. 9B, the base plate component 34 is contiguous with bottom walls of the conductor clamping portion 32 and the clamping body 33 and is connected to a carrier. Also, a distal end of the base plate component 34 is integrally formed with a substantially triangular tongue 38, which is bent with a substantially triangular tongue 38 formed in the same shape at a distal end of the second overlapping fold plate component 36 to be formed into a guide portion 39.

With such a structure discussed above, since the male terminal fitting 30 is comprised of the first overlapping fold plate component 35 interposed between the base plate component 34 and the second overlapping fold plate component 36, the conductor clamping portion 32 has an increased strength. Therefore, even when the male terminal fitting 30 is applied with external press forces during press forming operation, no deformation is caused in the base plate component 34 and the second overlapping fold plate component 36 while precluding central areas of the contact protrusion from being collapsed. Thus, it is possible for the base plate component 34 and the second overlapping fold plate component 36 to have a remarkably increased strength in a reliable manner.

Furthermore, the second overlapping fold plate component 36, which serves as the flatness securing plate component, is formed so as to extend from the first overlapping fold plate component 35 in the substantially parallel to the base plate component 34, resulting in a decrease in waste material while avoiding an increase in the material cost.

In addition, in the male terminal fitting 30, the planar-shaped securing plate component 36, the base plate component 34 and the second overlapping fold plate component 36 overlaps with respect to one another in the substantially S-shape in cross section. Accordingly, when the plate-shaped contact protrusion 31 is tightly fitted to a female terminal fitting, an electrical contact is ensured between the plate-shaped contact protrusion 31 and the female terminal fitting in a reliable manner using the spring back actions of the respective folded portions.

Now, a male terminal fitting of a third preferred embodiment is described below in conjunction with FIGS. 10A to 10C.

Figure 10A:
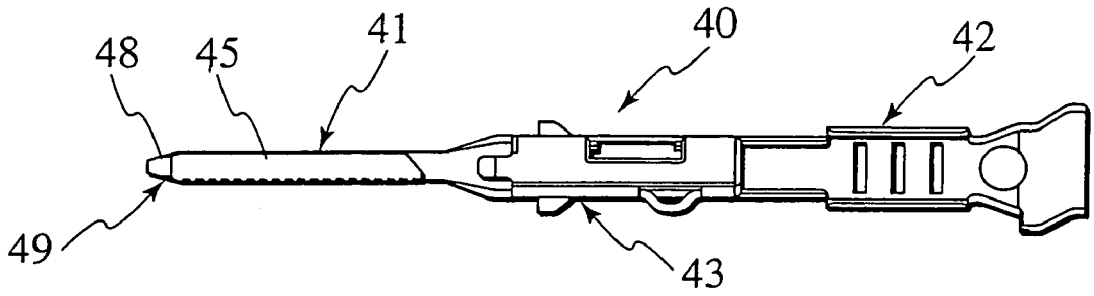
FIG. 10A is a plan view of a male terminal fitting of a third preferred embodiment according to the present invention.

FIG. 10A is a plan view illustrating the male terminal fitting 40 of the third preferred embodiment. FIG. 10B is a side view of the male terminal fitting 40 of the third preferred embodiment, and FIG. 10C is a cross sectional view taken on line X—X of FIG. 10B.

Figure 10B:
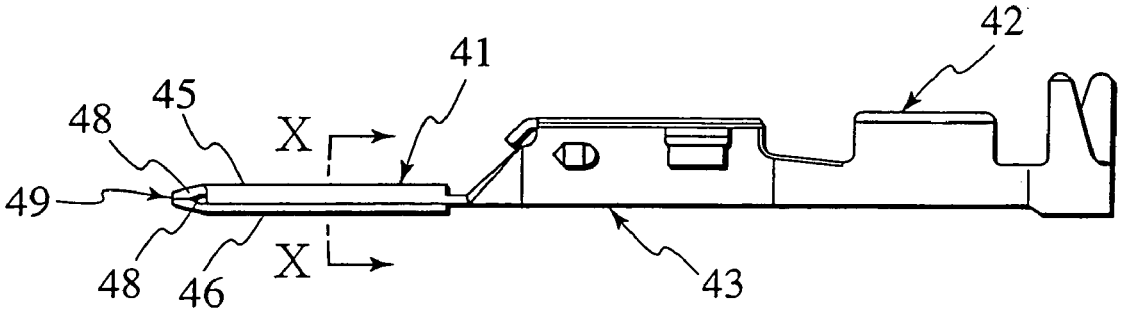
FIG. 10B is a side view of the male terminal fitting shown in FIG. 10A.
Figure 10C:
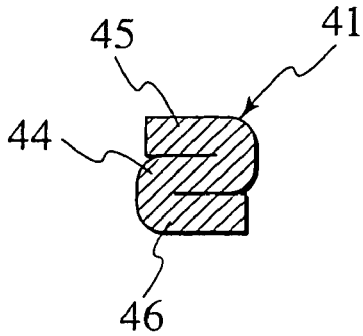
FIG. 10C is a cross sectional view taken on line X—X of FIG. 10B.

In the third preferred embodiment shown in FIGS. 10A to 10C, a plate-shaped contact protrusion 41 is comprised of a base plate component 44 longitudinally extending from a conductor clamping portion 42 and made of elongated metal sheet, a first overlapping fold plate component 45 laterally extending from one side of the base plate component 44 and folded to overlap with the base plate component 44, and a second overlapping fold plate component 46 which laterally extends from the other side of base plate component 44 and overlaps with the base plate component 44 in a substantially parallel thereto and in an orientation opposed to the first overlapping fold plate component 45, thereby forming a substantially S-shape in cross section. The base plate component 44, which functions as the flatness securing plate component, ensure the first overlapping fold plate component 45 and the second overlapping fold plate component 46 to have desired flatness conditions, respectively.

Further, the male terminal fitting 40 of the second preferred embodiment has a similar shape in structure as that of the first preferred embodiment except for the plate-shaped contact protrusion 41. As shown in FIG. 10B, the base plate component 44 is contiguous with bottom walls of the conductor clamping portion 42 and the clamping body 43 and is connected to a carrier. Also, a distal end of the base plate component 44 is integrally formed with a substantially triangular tongue 48, which is bent with a substantially triangular tongue 48 formed in the same shape at a distal end of the second overlapping fold plate component 46 to be formed into a guide portion 49.

With such a structure discussed above, since the male terminal fitting 40 is comprised of the base plate component 44 overlapped between first overlapping fold plate component 45 and the second overlapping fold plate component 46, the conductor clamping portion 42 has an increased strength. Therefore, even when the male terminal fitting 40 is exerted with the external press forces during the press forming operation, no deformation is caused in the first and second overlapping fold plate components 45, 46 while precluding central areas of the contact protrusion from being collapsed. Thus, it is possible for the first and second overlapping fold plate components 45, 46 to have a remarkably increased strength in a reliable manner.

Furthermore, the first overlapping plate component 46 is formed so as to extend from one side of the base plate component 44, and the second overlapping fold plate component 45 extend from the other side of the base plate component 44, resulting in a decrease in waste material while avoiding an increase in the material cost.

In addition, in the male terminal fitting 40, the base plate component 44 serving as the flatness securing plate component is overlapped between the first and second overlapping fold plate components 45, 46 in three layers to form a substantially S-shape configuration in cross section. Accordingly, when the plate-shaped contact protrusion 41 is tightly fitted into a female terminal fitting, an electrical contact is ensured between the plate-shaped contact protrusion 41 and the female terminal fitting in a reliable manner using the spring back actions of the respective bent portions.

Now, a male terminal fitting of a fourth preferred embodiment is described below in conjunction with FIGS. 11A to 11D.

Figure 11A:
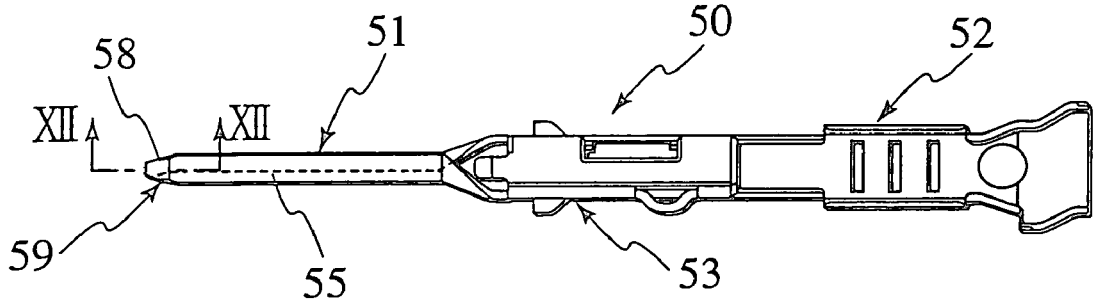
FIG. 11A is a plan view of a male terminal fitting of a fourth preferred embodiment according to the present invention.
Figure 11B:
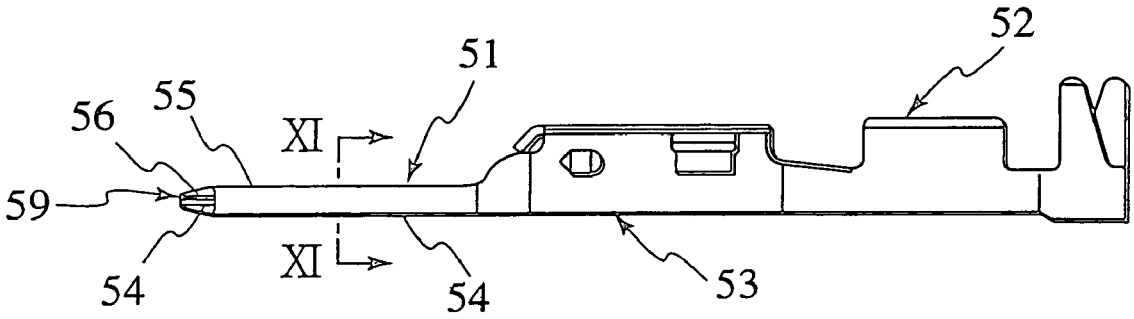
FIG. 11B is a side view of the male terminal fitting shown in FIG. 11A.
Figure 11C:
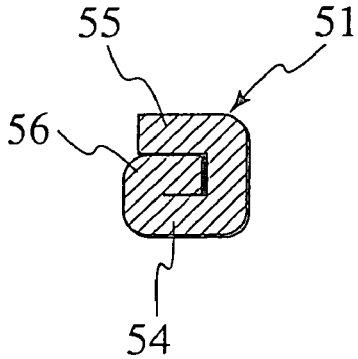
FIG. 11C is a cross sectional view taken on line XI—XI of FIG. 11B.
Figure 11D:
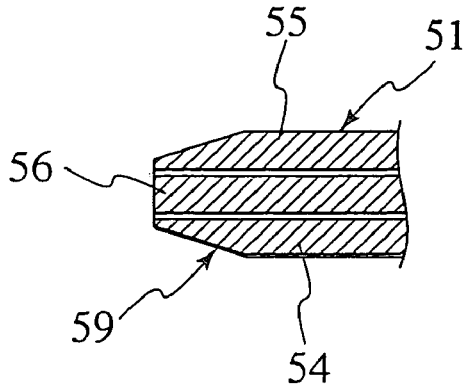
FIG. 11D is a cross sectional view taken on line XII—XII of FIG. 11B.

FIG. 11A is a plan view illustrating the male type terminal fitting 50 of the fourth preferred embodiment. FIG. 11B is a side view of the male terminal fitting 50 of the fourth preferred embodiment, FIG. 11C is a cross sectional view taken on line XI—XI of FIG. 11B. FIG. 11D is an enlarged cross sectional view of a guide portion taken on line XII—XII of FIG. 11A.

In the fourth preferred embodiment shown in FIGS. 11A to 11D, a plate-shaped contact protrusion 51 is comprised of a base plate component 54 longitudinally extending from a conductor clamping portion 52 and made of elongated metal sheet, an overlapping fold plate component 55 laterally extending from one side of the base plate component 54 and folded to overlap with the base plate component 54, and a flatness securing plate component 56 which laterally extends from the other side of base plate component 54 and overlaps with the base plate component 54 and the overlapping fold plate component 5, thereby forming a substantially roll shape in cross section. The flatness securing plate component 56 ensures the base plate component 54 and the overlapping fold plate component 55 to have desired flatness conditions, respectively.

Further, as best shown in FIG. 11D, a guide portion 59 is formed with the base plate component 54, the overlapping fold plate component 55 and the flatness securing plate component 56 into a roll shape as done in the plate-shaped contact protrusion 51.

In addition, the guide portion 59 is formed in a tapered shape that has two pairs of opposed surfaces which are tapered toward respective distal ends.

Further, the male terminal fitting 50 of the fourth preferred embodiment has a similar shape in structure as that of the first preferred embodiment except for the guide portion 59. As shown in FIG. 11B, the base plate component 54 is contiguous with bottom walls of the conductor clamping portion 52 and the clamping body 53 and is connected to a carrier.

With such a structure discussed above, since the male terminal fitting 50 is comprised of the flatness securing plate component 56 which overlaps with the base plate component 54 and the overlapping fold plate component 55, no empty space is internally created to allow the guide portion 59 to have an increased strength. Thus, it is possible to remove a bending step for bending the distal ends of the guide portion 59 during a forming operation thereof, precluding the base plate component 54 and the overlapping fold plate component 55 from being deformed.

In addition, the presence of the guide portion with the increased strength enables the guide portion 59 to be prevented from being deformed even when the male terminal fitting 50 is repeatedly fitted into the female terminal fitting.

In the fourth preferred embodiment discussed above, also, while the flatness securing plate component 56 has been shown and described as extending from the other side of the base plate component 54, the flatness securing plate component may extend from the overlapping fold plate component 55.

The entire content of a Japanese Application No. 2001-238137 With a filing date of Aug. 8, 2001 is herein incorporated by reference.

Although the present invention has been shown and described with reference to the particular preferred embodiment of the present invention, the present invention is not limited to the particular embodiments discussed above and various other changes, modifications and variations may be made to those skilled in the art in light of the overall teachings of the disclosure. The spirit and scope of the invention are defined with reference to the following appended claims.

The invention claimed is:

1. A method of manufacturing a male terminal fitting, said method comprising:

preparing a blank sheet of elongated conductive metal sheet;

stamping said elongated conductive metal sheet to form a plurality of sequentially arrayed terminal fittings, in developed states, which are integrally connected to a carrier, each of said terminal fittings including a conductor clamping portion extending from said carrier, a clamping body connected to said conductor clamping portion, and a plate-shaped contact protrusion which is composed of a base plate component longitudinally extending from said conductor clamping portion via said clamping body, a flatness securing plate component laterally extending from one side of said base plate component, and an overlapping fold plate component laterally extending from the other side of said base plate component; and forming said conductor clamping portion, said clamping body and said plate-shaped contact protrusion into respective final shapes, wherein, after said forming step, said flatness securing plate overlaps with said overlapping fold plate component to ensure flatness conditions of said base plate component and said overlapping fold plate component.

2. A method of manufacturing a male terminal fitting, said method comprising:

preparing a blank sheet of elongated conductive metal sheet;

stamping said elongated conductive metal sheet to form a plurality of sequentially arrayed terminal fittings, in developed states, which are integrally connected to a carrier, each of said terminal fittings including a conductor clamping portion extending from said carrier, a clamping body connected to said conductor clamping portion, and a plate-shaped contact protrusion which is composed of a base plate component longitudinally extending from said conductor clamping portion via said clamping body, a first overlapping fold plate component laterally extending from one side of said base plate component, and a second overlapping fold plate component laterally extending from the other side of said base plate component; and forming said conductor clamping portion, said clamping body, and said plate-shaped contact protrusion into respective final shapes, wherein, after said forming step, said base plate component overlaps with said first and second overlapping fold plate components and serves as a flatness securing plate component to ensure flatness conditions of said base plate component and said first and second overlapping fold plate components.

3. A method of manufacturing a male terminal fitting, said method comprising:

preparing a blank sheet of elongated conductive metal sheet;

stamping said elongated conductive metal sheet to form a plurality of sequentially arrayed terminal fittings, in developed states, which are integrally connected to a carrier, each of said terminal fittings including a conductor clamping portion extending from said carrier, a clamping body connected to said conductor clamping portion, and a plate-shaped contact protrusion which is composed of a base plate component longitudinally extending from said conductor clamping portion via said clamping body, a flatness securing plate component laterally extending from one side of said base plate component, and an overlapping fold plate component laterally extending from the other side of said base plate component; and forming said conductor clamping portion, said clamping body, and said plate-shaped contact protrusion into respective final shapes, wherein, after said forming step, said flatness securing plate component overlaps with said base plate component and said overlapping fold plate component to ensure flatness conditions of said base plate component and said overlapping fold plate component, respectively.

* * * * *